US006652237B2

(12) United States Patent
Yehle et al.

(10) Patent No.: US 6,652,237 B2
(45) Date of Patent: Nov. 25, 2003

(54) BUCKET AND WHEEL DOVETAIL DESIGN FOR TURBINE ROTORS

(75) Inventors: Gary Edward Yehle, Clifton Park, NY (US); Noel Jacob Bylina, Niskayuna, NY (US); Wayne Alan Lillibridge, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 86 days.

(21) Appl. No.: 09/976,295

(22) Filed: Oct. 15, 2001

(65) Prior Publication Data

US 2003/0077176 A1 Apr. 24, 2003

(51) Int. Cl.[7] ..... F01D 5/32

(52) U.S. Cl. ..... 416/219 R; 416/222; 416/248

(58) Field of Search ..... 416/219 R, 248, 416/222

(56) References Cited

U.S. PATENT DOCUMENTS

| | | | | | |
|---|---|---|---|---|---|
| 1,353,797 | A | * | 9/1920 | Steensrtup | 416/222 |
| 4,730,984 | A | * | 3/1988 | Ortolano | 416/222 |
| 5,174,720 | A | * | 12/1992 | Gradl | 416/219 R |
| 5,474,423 | A | | 12/1995 | Seeley et al. | 416/222 |
| 5,494,408 | A | | 2/1996 | Seeley et al. | 416/222 |
| 5,531,569 | A | | 7/1996 | Seeley | 416/222 |
| 6,142,737 | A | * | 11/2000 | Seeley et al. | 416/219 R |

* cited by examiner

*Primary Examiner*—Edward K. Look
*Assistant Examiner*—Igor Kershteyn
(74) *Attorney, Agent, or Firm*—Nixo & Vanderhye

(57) ABSTRACT

A dovetail joint between a rotor wheel and a bucket includes a male dovetail component on the rotor wheel and a female dovetail component on the bucket. The male dovetail component has axially projecting hooks with slanted surfaces along generally radially inwardly directed surfaces. The slanted surfaces form included angles with a plane normal to the axis of rotation and bisecting the wheel dovetail which are larger than 90° and remain constant for all of the hooks. Single radius fillets are also provided along the transition surfaces between the slanted crush surfaces and the neck surfaces. The stress concentrations are therefore minimized.

14 Claims, 6 Drawing Sheets

BUCKET AND WHEEL DOVETAIL DESIGN FOR TURBINE ROTORS

The present invention relates to turbines and particularly to dovetail joints between the wheel of a steam turbine rotor and steam turbine buckets.

BACKGROUND OF THE INVENTION

Dovetail attachment techniques between turbine buckets and turbine rotor wheels for steam turbines are well known in the art. Conventional tangential entry dovetails on the latter stages of low-pressure rotors operating in a contaminated steam environment have been found to be conducive to stress corrosion cracking (SCC). SCC is accelerated by the stress levels that are present in the hook fillet regions of typical dovetail configurations. Normally, these stresses are acceptable but with contaminated steam, cracks can initiate and, if left undetected, may grow to a depth that will cause failure of the wheel hooks. In extreme cases, all the hooks will fail and buckets will fly loose from the rotor. Long experience with bucket-to-wheel dovetail joints has indicated that the wheel hooks crack but that the bucket hooks do not crack. This is apparently because the NiCrMoV and similar low-alloy steels used for low-pressure rotors are much less resistant to SCC than are the 12Cr steels used for buckets. The steels for the wheels give the optimum combination of properties available for overall low-pressure rotor design considerations. Thus, an effective means of avoiding SCC in the typical low-pressure steam environment is to reduce the stresses in the wheel dovetail to acceptable levels. If the maximum stress in components operating in a corrosive environment is below the yield strength of the material, the resistance to SCC is greatly improved.

Bucket and wheel dovetail designs for steam turbine rotors have been described and illustrated in U.S. Pat. Nos. 5,474,423, 5,494,408; and 5,531,569, of common assignee. In U.S. Pat. No. 5,474,423 the dovetail joint design provides four hooks on the rotor wheel which decrease in thickness from the radially-outermost hooks to the innermost hooks. Additionally, fillets are provided between neck portions of the rotor wheel dovetails and bottom surfaces of the overlying hooks, with multiple radii, i.e., compound fillets, in order to decrease the stress concentrations with increased radii of the fillets. Additional features of that prior design include a flat surface along the radially-outermost surface of the hook and in combination with various forms of compound fillets. In U.S. Pat. No. 5,494,408 different fillet radii are provided between the hooks. In U.S. Pat. No. 5,531,569, compound fillet radii are disclosed.

BRIEF SUMMARY OF THE INVENTION

In accordance with the present invention, a rotor wheel and bucket dovetail joint design is provided which minimizes concentrated stresses caused by the centrifugal force of the buckets in the wheel hook fillets, and permits larger hook fillet radii which further reduces stress concentration. In accordance with a principal aspect of the present invention, the rotor wheel contact surfaces, i.e., the generally radially-inwardly facing surfaces along the undersides of the wheel hooks are provided with identical slant surface angles for each hook of the dovetail at different radii along the dovetail. It will be appreciated that the rotor rotation causes the buckets to develop centrifugal forces which are imposed on the dovetail through the contact surfaces along the undersides of the wheel hooks. These forces give rise to stresses in the dovetail with peak stresses in the fillet regions of the hooks. The slant surfaces reduce the stress concentration for a given fillet radius and permit larger hook fillet radii that further reduce the stress concentration.

More particularly, the crush surfaces for traditional tangential entry dovetails are on an axial-circumferential plane with a fillet used as a transition between the crush surface and the neck surface at the various locations along the dovetail. These two surfaces are 90° apart in conventional tangential entry dovetails. In U.S. Pat. No. 6,142,737, of common assignee, the two surfaces are greater than 90° apart but vary from hook to hook. In the present invention, these crush surfaces are rotated such that the transition angles between the crush surfaces, i.e., slant surfaces, and the neck surfaces (in a radial plane) are greater than 90° and are the same at each hook radii. The angles of rotation are called slant angles. Concentrated stresses result when load paths are forced to change direction. With the slanted crush surfaces hereof, the change in direction from 90° to larger angles is less severe and the stress concentration is therefore lower. The slant crush surface also permits a larger fillet radius in the same transition distance as compared to the conventional 90° transition, with a resulting larger fillet radius and lower concentrated stress. It will also be appreciated that a slanted crush surface causes a component of force in the axial direction which gives rise to bending of the bucket leg and an axial load on the tang of the wheel dovetail. To minimize this effect, the slant angle is constant from hook to hook, i.e., the same slant angle is provided at each hook radii. Because the slant angles of the crush surfaces are increased in angle from 90°, the fillet radii are also increased and stress concentrations thereby reduced.

In a further aspect, it will be appreciated that hook thickness and length control the load sharing between hooks, as well as the bending and shear stresses on hooks. Consequently, the hook thickness is varied to achieve uniform and minimum concentrated stresses, i.e., hook thickness increases with decreasing radial height.

The invention as described herein relates to both three hook and four-hook dovetail designs. The invention is also useful with other dovetails with any number of hooks. Additionally, the invention is not limited to rotors susceptible to SCC and the benefits and advantages hereof can be realized for other stress-causing conditions which initiate cracking in dovetail hooks such as dovetail cracking in high-temperature regions when creep is the failure mode rather than SCC.

In a preferred embodiment according to the present invention, there is provided a dovetail joint between a rotor wheel and a bucket rotatable about an axis, comprising a male dovetail component on the rotor wheel and a female dovetail component on the bucket, the male dovetail component receiving the female dovetail component in a direction tangential to the rotor wheel, the male dovetail component including a plurality of circumferentially extending hooks lying on opposite sides of a plane normal to the axis and bisecting the male dovetail component, each hook having a generally radially inwardly-facing surface, the surfaces of at least a pair of hooks on each of the opposite sides of the plane defining angles extending away from the plane and toward and away from the axis, the angles of the surfaces of each pair of hooks on each of the opposite sides of the plane being equal to one another.

In a further preferred embodiment according to the present invention, there is provided for use in a steam turbine dovetail joint that has a constant angle contact surface between a rotor wheel and a bucket both rotatable about an axis, the combination of the rotor wheel and bucket wherein the rotor wheel includes a male dovetail component for receiving the female dovetail component in a direction tangential to the rotor wheel, said male dovetail component including a plurality of circumferentially extending hooks lying on opposite sides of a plane normal to the axis and bisecting the male dovetail component, each hook having a generally radially inwardly-facing surface with the surfaces of each of the hooks on opposite sides of the plane defining angles extending away from the plane and toward and away from the axis, the angle of each surface being equal to the angle of every other surface, a female dovetail component on each bucket including a plurality of circumferentially extending hooks generally complementary to the male dovetail hooks and having radially outwardly directed angled surfaces generally complementary to the angled surfaces of the male dovetail component, the angles of the surfaces of the female dovetail component being equal to one another.

DETAILED DESCRIPTION OF THE INVENTION

Figure 1:
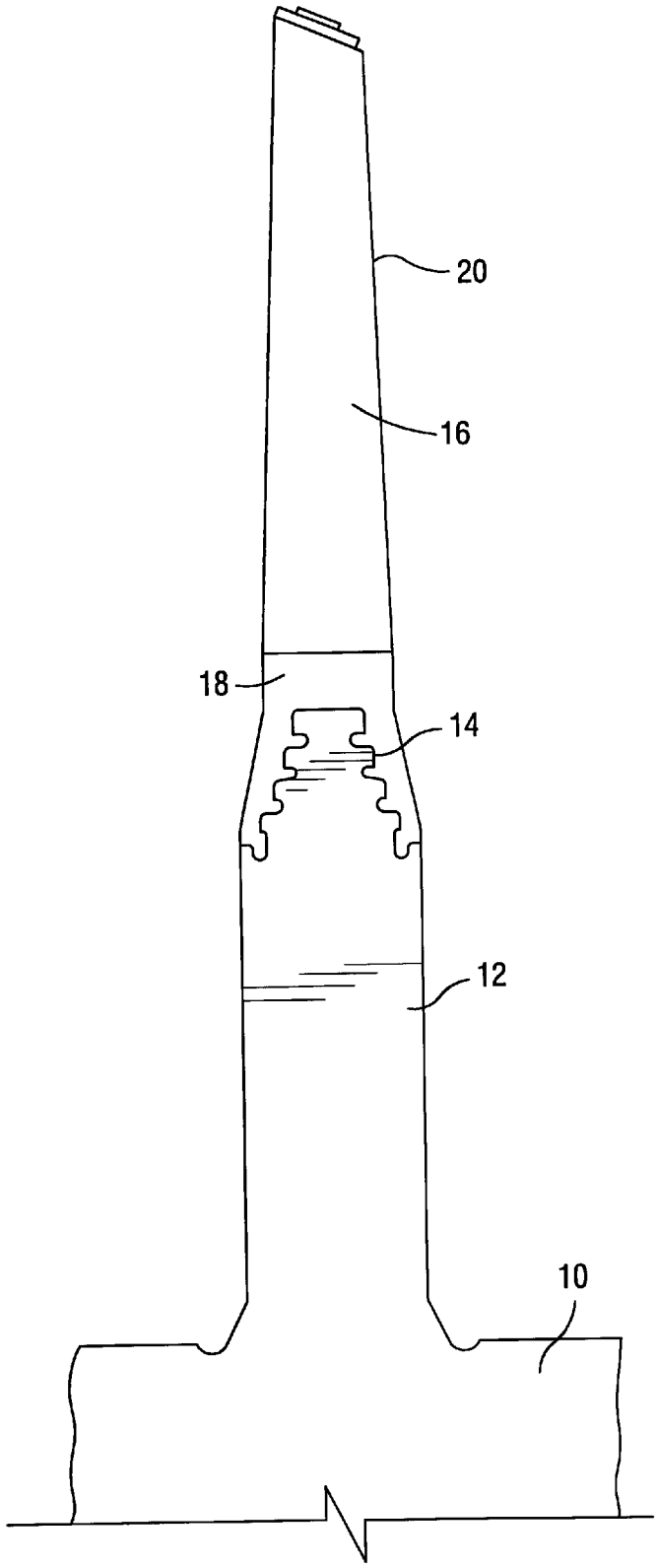
Fig. 1 (PRIOR ART)
FIG. 1 is a schematic representation of a typical turbine rotor wheel and bucket dovetail joint.

Referring to FIG. 1, there is illustrated a rotor body, for example, a shaft 10, mounting a rotor wheel 12, terminating along its outer radius in a series of male dovetail components 14. The turbine buckets 16 each include a female dovetail joint 18 along its radial innermost portion for mating with the male dovetail joint 14, the bucket 16 including a blade 20 extending from the female dovetail component 18. As will be appreciated, the dovetail joint is a tangential entry-type dovetail arrangement.

Figure 2:
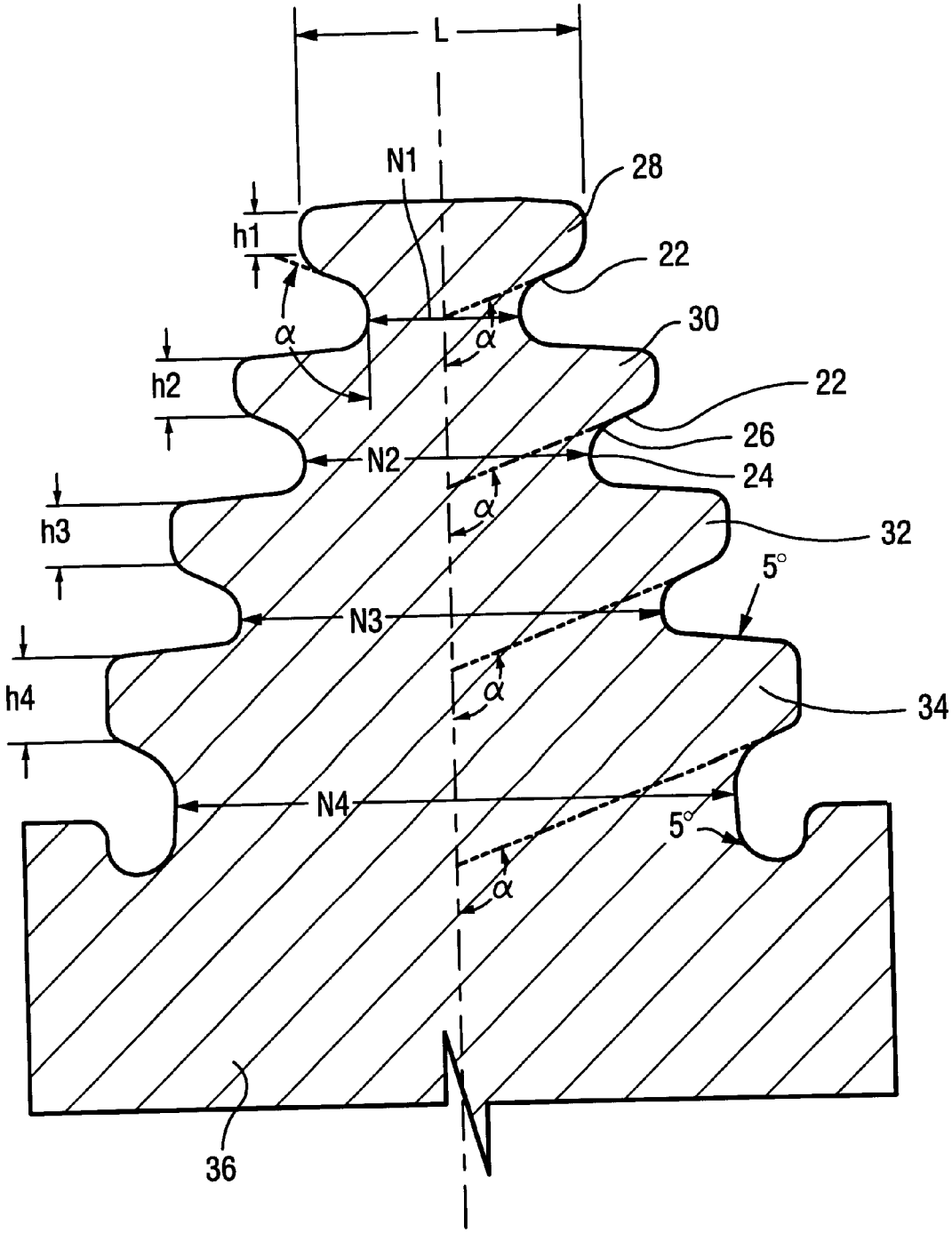
FIG. 2 is a cross-sectional view of a turbine wheel dovetail in accordance with the present invention.

In the ensuing description, it will be appreciated that the dovetails are symmetric in a radial plane normal to the axis of rotation of shaft 10 and that it is accepted practice to refer only to half the dovetail, i.e., the dovetail hooks along one side of the radial plane. Thus, the present description with respect to FIGS. 2–4 refers to four hooks forming the dovetail, even though there are actually eight hooks in the dovetail joint. In conventional practice, the hooks are referred to sequentially as first, second, third and fourth hooks from the radially-outermost hook to the radially-innermost hook. Further, the contact surfaces between the wheel hooks and the bucket hooks are known as crush or slant surfaces. The crush or slant surface for tangential entry dovetails lies on an axial circumferential plane with a fillet employed as a transition between the crush surface and the neck surface of the dovetail. As illustrated in FIG. 2, crush surfaces 22, neck surfaces 24 and fillets 26 between those surfaces are provided each of the hooks 28, 30, 32 and 34 of the wheel dovetail 36 which forms the joint with the female dovetail 38 of the bucket.

As will be appreciated from a review of FIG. 2, the slanted crush surfaces 22 of each of the hooks forms an angle $\alpha$ with a radial plane passing through the neck of each hook of the dovetail, the angles opening away from the plane and both toward and away from the rotor axis. In FIG. 2, four hooks 28, 30, 32 and 34 are illustrated. Consequently, the slanted crush surface 22 of each hook 28 also forms an angle $\alpha$ with a radial plane bisecting the male dovetail. Thus, it will be appreciated that the slanted crush surfaces 22 are at a constant angle to the horizontal throughout the height of the wheel dovetail. By forming slanted crush surfaces 22 at an angle to the horizontal, stress concentrations for a given fillet radius are reduced and enable larger hook fillet radii that further reduce the stress concentrations. Concentrated stresses result when load paths are forced to change direction. With the slanted crush surface, and particularly the same crush surface angle $\alpha$ for each hook, the change in direction is less severe and the stress concentration is lower. A further advantage of the slanted crush surface is that it permits a larger fillet radius in the same transition distance as compared with the prior art zero degree (0°) transition, i.e., a crush surface parallel to the horizontal.

In a preferred embodiment, the angle $\alpha$ is preferably one hundred ten degrees (110°) for each crush slant surface 22. Further, the larger fillet radius permitted by the slanted crush surfaces, while enabling lower concentrated stresses, also reduces the stress in the fillet area. In accordance with a preferred embodiment of this invention, each of the fillet radii transitioning between the slanted crush surface 22 and the neck portion 24 are enlarged.

The hook thickness and length also control the load sharing between the hooks as well as the bending and shear stress in the hook. All of this contributes to the degree of concentrated stress. Accordingly, the hook thickness and lengths are varied to achieve uniform and minimized concentrated stresses.

Figure 3:
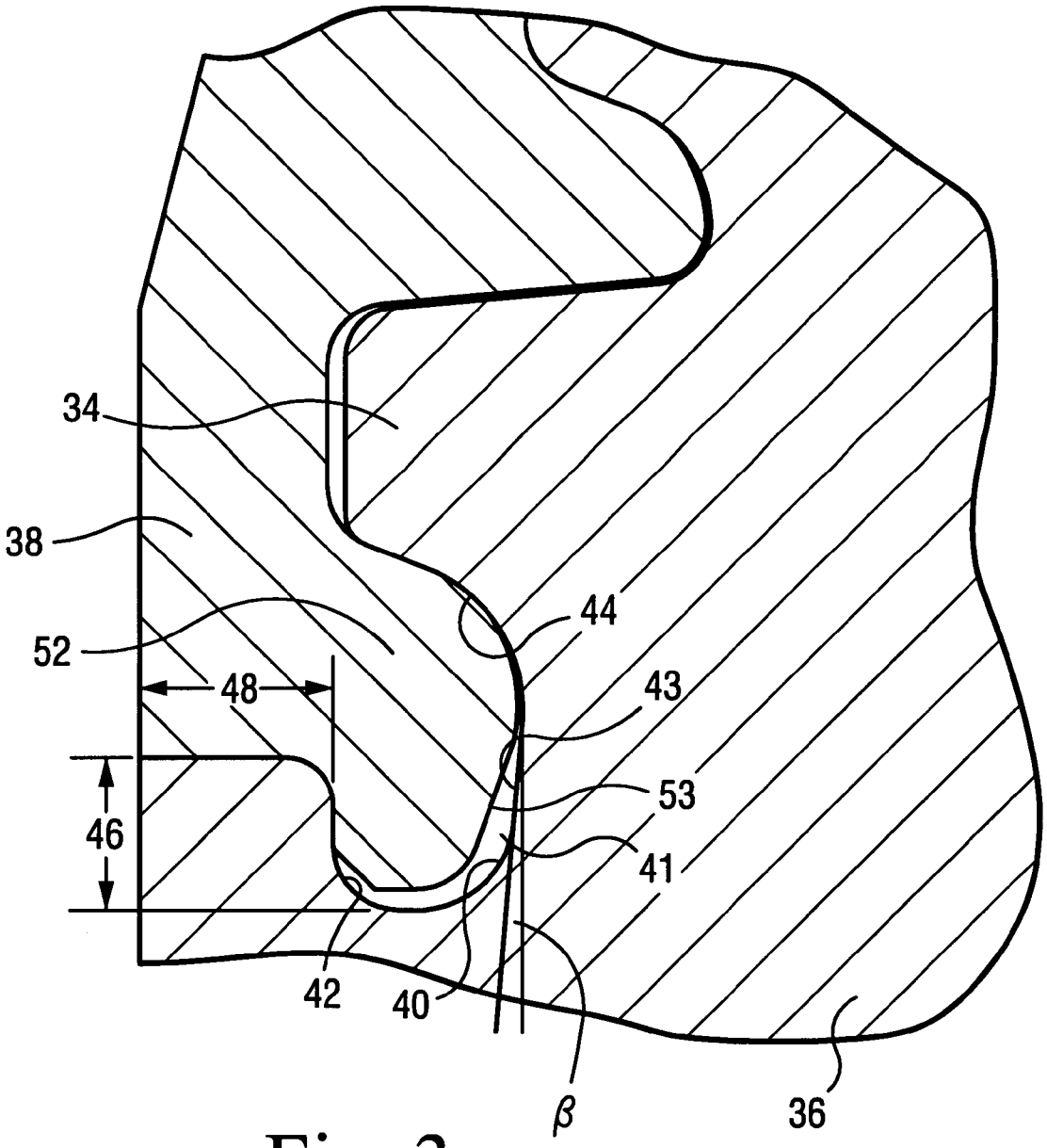
FIG. 3 is an enlarged fragmentary cross-sectional view of the fillet and tang area of a wheel and bucket dovetail joint in accordance with the present invention.

Referring to FIG. 3, the wheel dovetail 36 also includes a wheel pocket 41 having a pocket angle $\beta$ and an axially facing surface 43 angled in a radial inward direction away from a plane normal to the axis of the rotor. Wheel pocket angle $\beta$ is formed at an angle to the radial plane, preferably about five degrees (5°). The load path is thus forced to change direction and that change in direction produces a lower stress concentration. FIG. 3 also discloses the lower right and left fillets. Generally, these fillets are large to further reduce the stress concentration. For example, the right fillet 40, i.e., the inside fillet, has a 0.225 inch radius. The left fillet 42, i.e., the outside fillet, has a 0.140 inch radius. Traditionally, the hook fillet 44 has a 0.340 inch radius, the height 46 of the lug from the bottom of the pocket is 0.360 inches and the thickness 48 of the lug is 0.463 inches. The tang height and thickness controls the bending shear due to the axial load from the bucket and are designed to minimize tang fillet concentrated stresses.

Other significant dimensions relating to the disclosed exemplary embodiment of the present invention are as follows:

| Hook Axial Length L | | Hook Radial Height (h) |
|---|---|---|
| Hook 1 (28) | 1.850 inches | .362 inches (h1) |
| Hook 2 (30) | 2.750 inches | .341 inches (h2) |
| Hook 3 (32) | 3.650 inches | .424 inches (h3) |
| Hook 4 (34) | 4.518 inches | .532 inches (h4) |

The radial height extends from the axially outermost end of each top surface of the hook to the beginning of the slant surface along its underside as indicated by h1–h4 in FIG. 2.

The neck axial length N is as follows:

N1—between hooks 28 and 30—0.980 inches

N2—between hooks 30 and 32—1.880 inches

N3—between hooks 32 and 34—2.780 inches

N4—between hook 34 and tang—3.680 inches.

Figure 4:
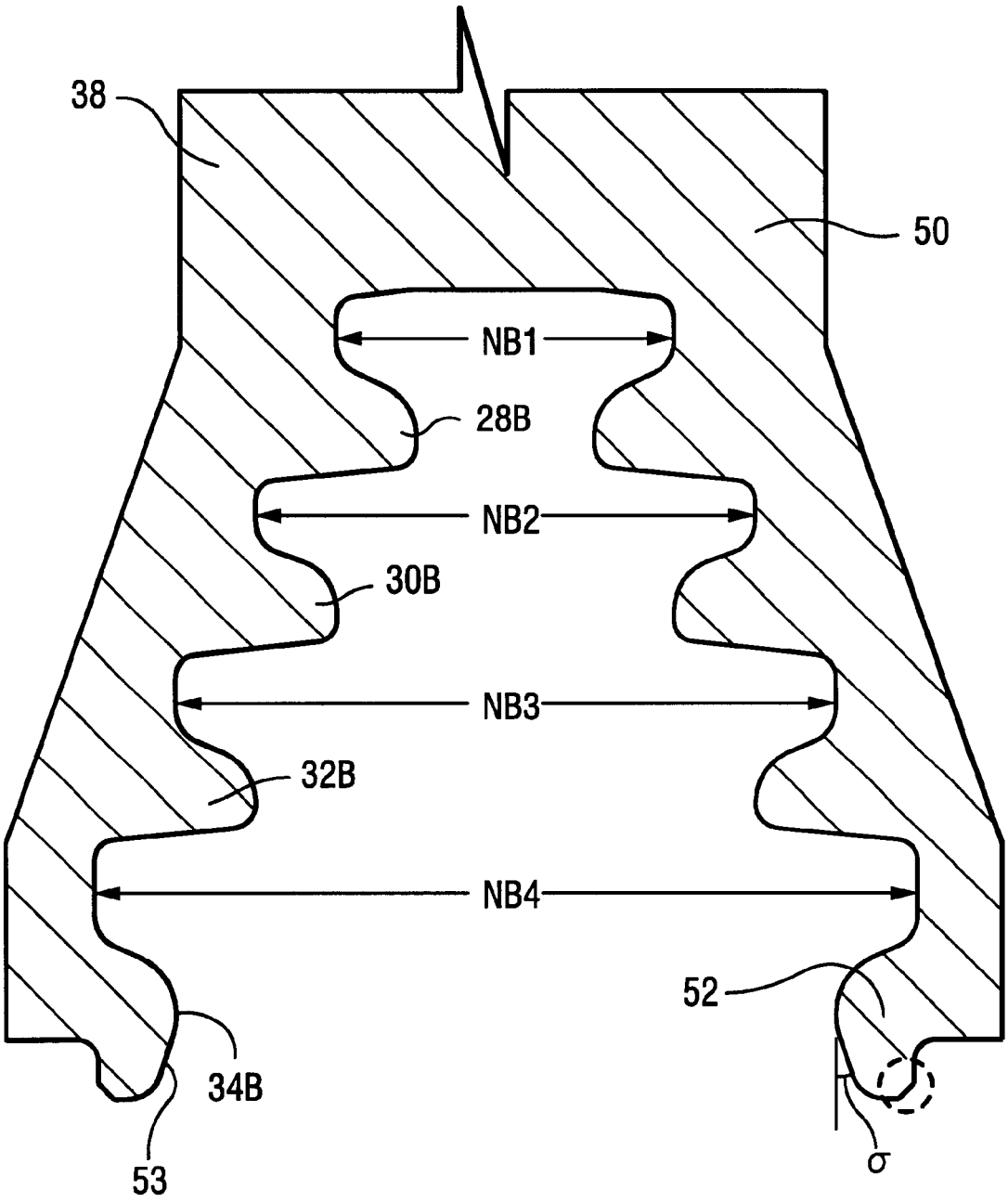
FIG. 4 is a cross-sectional view of a bucket dovetail joint for mating with the dovetail joint of the wheel dovetail of FIG. 2.

Referring to FIG. 4, the female dovetail 38 of the bucket 50 is illustrated and is generally complementary to the male dovetail component illustrated in FIG. 2. The various complementary components of the bucket dovetail are assigned like reference numerals as the wheel dovetail, followed by the suffix B. Except for tolerances, the dimensional characteristics of the bucket dovetail 38 are the same as or provided in close-fitting relation to the dimensional characteristics for the wheel dovetail with the additional exception that the hook or tang 52 includes an enlarged angle a of 20° with respect to the vertical. Note that the tang 52 includes an axial facing surface 53 angled in a radial direction away from a plane normal to the axis of the rotor and at a greater angle than the angled surface 43 of the male dovetail wheel pocket 41. In an illustrative embodiment:

Dovetail height of the bucket is 4.297 inches.

The axial length between hooks are as follows:

Hook 1 (28B)—1.000 inches

Hook 2 (30B)—1.900 inches

Hook 3 (32B)—2.800 inches

Hook 4 (34B)—3.700 inches.

The neck axial lengths NB are as follows:

NB1—above hook 28B—1.900 inches

NB2—above hook 30B—2.800 inches

NB3—above hook 32B—3.700 inches

NB4—above hook 34B—4.600 inches

With the foregoing dimensions, it will be appreciated that the dovetail shape minimizes concentrated stresses while maintaining an overall size compatible with existing steam paths. As compared, for example, with the design set forth in U.S. Pat. No. 6,142,737, the present invention provides a peak concentrated stress in the wheel dovetail of 48,920 psi for the same loading condition and this represents a 27% reduction in concentrated stress for those same conditions.

Figure 5:
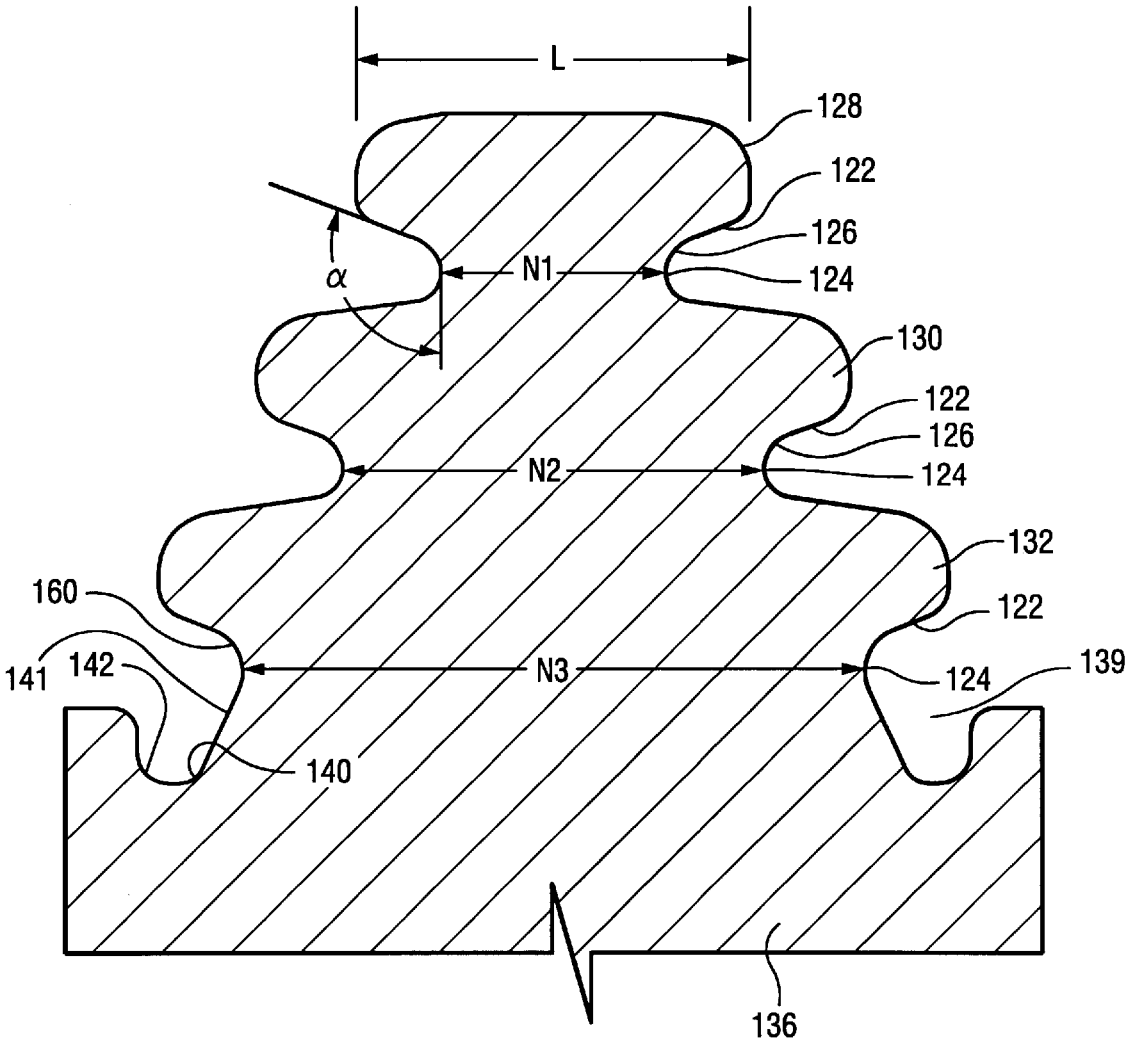
FIGS. 5 and 6 are views similar to FIGS. 2 and 4, respectively, of a further embodiment of the present invention.
Figure 6:
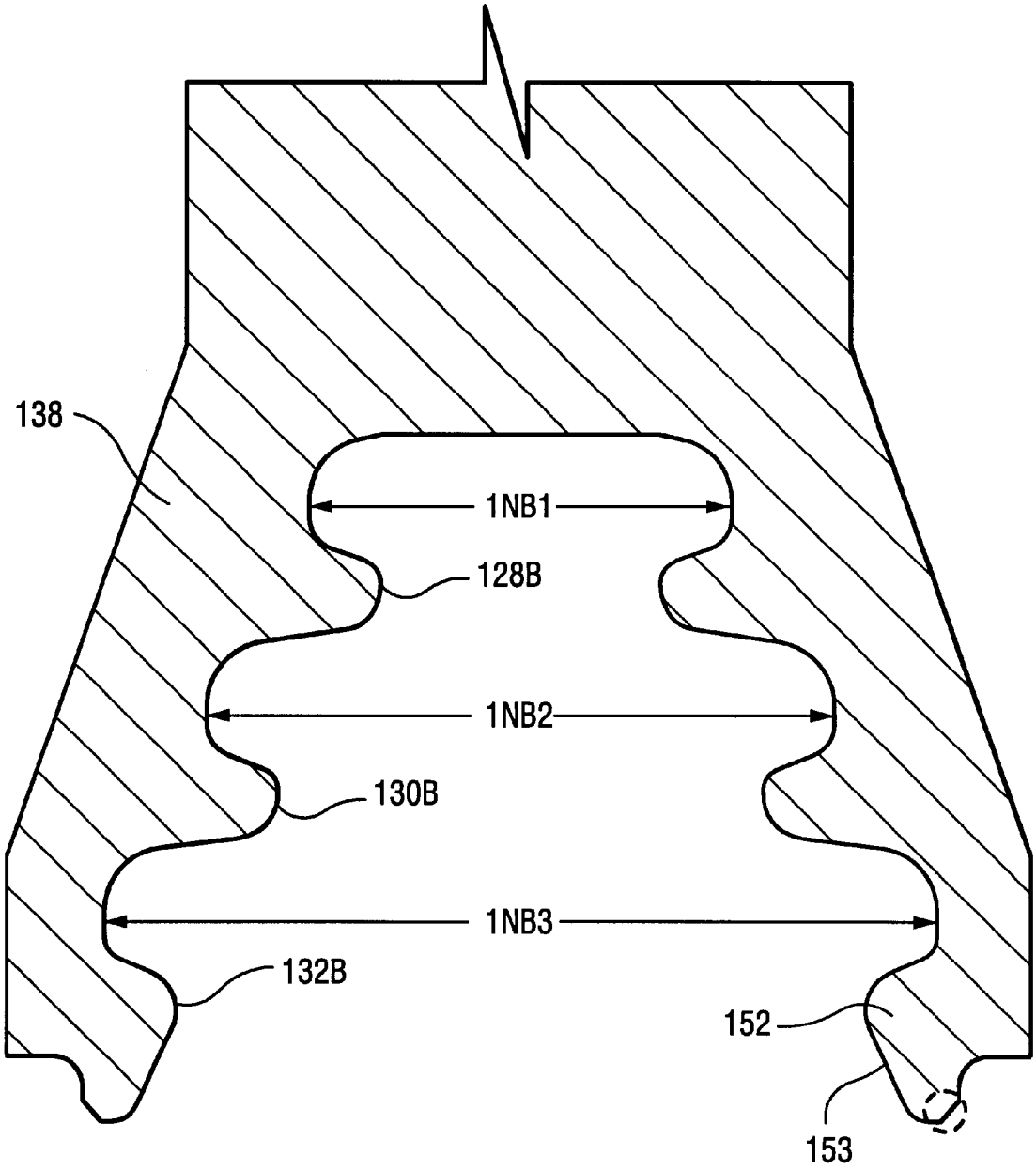

Referring now to FIGS. 5 and 6, there is illustrated a further embodiment of the present invention wherein like reference numerals are applied to like parts, preceded by the prefix 1. As illustrated, only three hooks instead of four as in the preceding embodiment are provided on each of the male dovetails 136 and the female dovetail 138. The crush surfaces 122 for each of the hooks 128, 130 and 132, as in the prior embodiment, have a fillet employed as a transition between the crush surface and the neck of the dovetail. Thus, the crush surfaces 122, neck surfaces 124 and fillets 126 between those surfaces are provided each of the hooks 128, 130 and 132. Similarly as in the preceding embodiment, each of the crush or slant surfaces forms an angle $\alpha$ with a radial plane passing through the neck of the dovetail, the angles opening away from the plane and both toward and away from the rotor axis. The slanted crush surfaces 122 are at a constant angle to the horizontal throughout the height of the wheel dovetail 136. As in the prior embodiment, these slanted crush surfaces reduce the stress concentrations for a given fillet and enable larger hook fillet radii that further reduce the stress concentrations. The preferred crush surface angle $\alpha$ is 110°.

Referring now to FIG. 5, the wheel pockets 139 in this embodiment of the present invention have an axially facing surface 141 angled in a radial inward direction away from a plane normal to the axis of the rotor. Also, the tang 152 includes an axial facing surface 153 angled in a radial direction away from a plane normal to the axis of the rotor and at a greater angle than the angled surface 141 of the male dovetail wheel pocket 139. The pockets 139 have right and left fillets 140 and 142, respectively, having radii of 0.094 and 0.140 inches. The radius for the fillet 160 underlying hook No. 3, i.e., hook 132, is 0.225 inches.

Other significant dimensions in this second embodiment of the present invention relating to the wheel dovetail are as follows:

| Hook Axial Length L | | Hook Radial Height (h) |
|---|---|---|
| Hook 1 (128) | 2.038 inches | .453 inches (h1) |
| Hook 2 (130) | 3.044 inches | .453 inches (h2) |
| Hook 3 (132) | 4.05 inches | .453 inches (h3) |

As in the prior embodiment, the radial height extends from the axially outermost end of each top surface of the hook to the beginning of the slant surface along its underside.

The neck axial length N is as follows:

N1—between hooks 128 and 130—1.154 inches

N2—between hooks 130 and 132—2.160 inches

N3—between hooks 132 and the tang—3.193 inches

The female dovetail 138 of the bucket is illustrated in FIG. 6 as generally complementary to the male dovetail component illustrated in FIG. 5. For example, note the tang 152 for reception in the wheel pocket 139. The various complementary components of the bucket dovetail of FIG. 6 are assigned like reference numerals as the wheel dovetail followed by the suffix B. Except for the tolerances, the dimensional characteristics of the bucket dovetail 138 are the same as or provided in close-fitting relation to the dimensional characteristics for the wheel dovetail 136. For example:

Dovetail height of the bucket in 3.340 inches

The axial length between the hooks are as follows:

Hook 1 (128B)—1.362 inches

Hook 2 (1308)—2.368 inches

Hook 3 (132B)—3.374 inches

The neck axial lengths 1NB are as follows:

INB1—above hook 128B—2.062 inches

INB2—above hook 130B—3.068 inches

INB3—above hook 132B—4.074 inches

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A dovetail joint between a rotor wheel and a bucket rotatable about an axis, comprising:

a male dovetail component on the rotor wheel and a female dovetail component on the bucket, said male dovetail component receiving said female dovetail component in a direction tangential to the rotor wheel, said male dovetail component including a plurality of circumferentially extending hooks lying on opposite sides of a plane normal to the axis and bisecting said male dovetail component, each said hook having a generally radially inwardly-facing surface;

said surfaces of all of pairs of said hooks on each of the opposite sides of the plane defining angles extending away from said plane and toward and away from said axis, the angles of said surfaces of all of pairs of said hooks on each of the opposite sides of the plane being equal to one another.

2. A joint according to claim 1 wherein neck portions join said surfaces and generally radially outwardly-facing portions of radially inwardly-underlying hooks, and fillets between said neck portions and said surfaces.

3. A joint according to claim 2 wherein neck portions join said surfaces and generally radially outwardly-facing portions of radially inwardly-underlying hooks, and fillets between said neck portions and said surfaces, wherein each hook from a radially-outermost hook to a radially-innermost hook increases in radial thickness.

4. A joint according to claim 3 Wherein said male dovetail has at least three hooks on each of the opposite sides of said plane.

5. A joint according to claim 3 wherein said male dovetail has four hooks on each of the opposite sides of said plane.

6. A joint according to claim 3 wherein said male dovetail has a wheel pocket adjacent a base and on opposite sides thereof, each wheel pocket having an axial facing surface angled in a radial inward direction away from said plane.

7. A joint according to claim 6 wherein said female dovetail has a tang for reception in said male dovetail wheel pocket, said tang having an axial facing surface angled in a radial inward direction away from said plane and at a greater angle than the angled surface of the male dovetail wheel pocket.

8. A joint according to claim 1 wherein each hook from a radially-outermost hook to a radially-innermost hook increases in radial thickness.

9. A joint according to claim 1 wherein said male dovetail has at least three hooks on each of the opposite sides of said plane.

10. A joint according to claim 1 wherein said male dovetail has four hooks on each of the opposite sides of said plane.

11. A joint according to claim 1 wherein said male dovetail has a wheel pocket adjacent a base and on opposite sides thereof, each wheel pocket having an axial facing surface angled in a radial inward direction away from said plane.

12. A joint according to claim 11 wherein said female dovetail has a tang for reception in said male dovetail wheel pocket, said tang having an axial facing surface angled in a radial inward direction away from said plane and at a greater angle than the angled surface of the male dovetail wheel pocket.

13. A joint according to claim 1 wherein the angles of said surfaces of each of said hooks are equal to one another.

14. For use in a steam turbine dovetail joint that has a constant angle contact surface between a rotor wheel and a bucket both rotatable about an axis, the combination of the rotor wheel and bucket wherein the rotor wheel includes a male dovetail component for receiving a female dovetail component in a direction tangential to the rotor wheel, said male dovetail component including a plurality of circumferentially extending hooks lying on opposite sides of a plane normal to the axis and bisecting said male dovetail component, each said hook having a generally radially inwardly-facing surface with the surfaces of each of the hooks on opposite sides of the plane defining angles extending away from said plane and toward and away from said axis, the angle of each surface being equal to the angle of every other surface, said female dovetail component on each bucket including a plurality of circumferentially extending hooks generally complementary to the male dovetail hooks and having radially outwardly directed angled surfaces generally complementary to said angled surfaces of the male dovetail component, the angles of said surfaces of the female dovetail component being equal to one another.

* * * * *

UNITED STATES PATENT AND TRADEMARK OFFICE

CERTIFICATE OF CORRECTION

PATENT NO. : 6,652,237 B2
DATED : November 25, 2003
INVENTOR(S) : Yehle et al.

It is certified that error appears in the above-identified patent and that said Letters Patent is hereby corrected as shown below:

Column 5,
Line 13, "angle a" should read -- angle σ --.

Column 6,
Line 39, "(1308)" should read -- (130B) --.
Line 65, "said surfaces of all of pairs of said hooks" should read -- said surfaces of all of said hooks --.

Column 7,
Line 1, "the angles of said surfaces of all of pair of said" should read -- the angles of said surfaces of all said --.

Signed and Sealed this

Thirteenth Day of April, 2004

JON W. DUDAS
*Acting Director of the United States Patent and Trademark Office*